US007823802B1

(12) United States Patent
Roche et al.

(10) Patent No.: US 7,823,802 B1
(45) **Date of Patent: *Nov. 2, 2010**

(54) EXTENSIBLE STRAW FOR A DISPOSABLE COLLAPSIBLE DRINK MIXING CONTAINER

(76) Inventors: Sharla D. Roche, 347 Hilltop Dr., North Aurora, IL (US) 60542; Gary V. VanMeter, 24744 Skaggs City Rd., Tecumseh, OK (US) 74873

( * ) Notice: Subject to any disclaimer, the term of this patent is extended or adjusted under 35 U.S.C. 154(b) by 168 days.

This patent is subject to a terminal disclaimer.

(21) Appl. No.: 11/900,060

(22) Filed: Sep. 10, 2007

Related U.S. Application Data

(63) Continuation-in-part of application No. 11/397,219, filed on Apr. 4, 2006, now abandoned.

(51) Int. Cl.
*A47G 21/18* (2006.01)
*A61J 15/00* (2006.01)
*E03B 9/20* (2006.01)

(52) U.S. Cl. ..... 239/33; 239/16; 251/229; 446/71

(58) Field of Classification Search ..... 239/16, 239/33; 215/229; 426/85; 446/71
See application file for complete search history.

(56) References Cited

U.S. PATENT DOCUMENTS 2,128,448 A * 8/1938 Wright ..... 426/85
2,288,848 A * 7/1942 Schuessler ..... 239/33
2,392,479 A * 1/1946 Humbert ..... 229/103.1
2,724,536 A * 11/1955 Pugh, Sr. ..... 229/103.1
2,997,195 A * 8/1961 Yuen ..... 215/388
3,143,429 A 8/1964 Swanson
3,173,566 A * 3/1965 Talbert ..... 215/229
3,434,589 A 3/1969 Valtri et al
3,542,190 A 11/1970 Keller
3,542,566 A 11/1970 Wakefield
4,688,721 A 8/1987 Inaba
4,850,533 A 7/1989 Hoshi et al.
5,029,719 A * 7/1991 Solomon ..... 215/229
D327,848 S 7/1992 Hanover
5,221,016 A * 6/1993 Karpal ..... 215/12.2
5,384,138 A 1/1995 Robbins
5,609,899 A 3/1997 Spector
5,731,021 A 3/1998 Spector
5,820,023 A * 10/1998 Kristensson ..... 239/33

(Continued)

FOREIGN PATENT DOCUMENTS

GB 2198622 A * 6/1988

OTHER PUBLICATIONS

International Preliminary Report on Patentability (PCT/US07/08486); issued Nov. 13, 2008 by the International Bureau of WIPO; 5 pages.

(Continued)

*Primary Examiner*—Len Tran
*Assistant Examiner*—James S Hogan
(74) *Attorney, Agent, or Firm*—Gable & Gotwals

(57) ABSTRACT

An extensible straw for incorporation as an integral component of a disposable or collapsible beverage container has telescoping tubes extensible from the container, a screw cap and multiple seals preventing inadvertent leakage from the container whether the container is maintained upright or not.

23 Claims, 7 Drawing Sheets

U.S. PATENT DOCUMENTS

| | | | | |
|---|---|---|---|---|
| 5,884,758 | A | 3/1999 | Sigouin et al. | |
| 5,937,617 | A | 8/1999 | Yeager | |
| 6,102,568 | A | 8/2000 | Davis | |
| 6,234,342 | B1 | 5/2001 | Cornell et al. | |
| 6,293,394 | B1 | 9/2001 | Marbler | |
| 6,298,885 | B1 | 10/2001 | Yoshino | |
| 6,427,928 | B1 | 8/2002 | Hirota | |
| 6,685,103 | B2 | 2/2004 | Hosi et al. | |
| 6,935,492 | B1 | 8/2005 | Loeb | |
| 2001/0002024 | A1 | 5/2001 | Edwards | |
| 2003/0221393 | A1 | 12/2003 | Kothari | |
| 2005/0061822 | A1* | 3/2005 | Naesje | 220/705 |
| 2005/0147329 | A1 | 7/2005 | Arvizu | |
| 2005/0173554 | A1* | 8/2005 | Kuwagaki et al. | 239/24 |
| 2006/0027675 | A1* | 2/2006 | Takeda | 239/33 |

OTHER PUBLICATIONS

International Search Report and Written Opinion from the International Searching Authority (ISA/US) dated Oct. 10, 2008 (7 pgs).

* cited by examiner

EXTENSIBLE STRAW FOR A DISPOSABLE COLLAPSIBLE DRINK MIXING CONTAINER

REFERENCE TO PENDING APPLICATIONS

This application is a continuation-in-part application claiming priority to U.S. patent application Ser. No. 11/397,219, filed Apr. 4, 2006, entitled Disposable Collapsible Drink Mixing Container.

REFERENCE TO MICROFICHE APPENDIX

This application is not referenced in any microfiche appendix.

BACKGROUND OF THE INVENTION

This invention relates generally to containers for beverages and more particularly concerns disposable containers for storing and mixing drink ingredients with water or other liquids and the straws used for dispensing the mixed beverage from the container to the consumer.

There are a variety of known disposable containers for carrying beverages in liquid form for consumption directly from the container. Some use straws, stored either inside or outside the container. There are also collapsible containers for carrying ingredients in a solid or concentrated liquid to be mixed with water or other liquids at the time of consumption. There are several problems and inconveniences inherent in the configuration of these known disposable and collapsible containers.

The disposable containers store the beverage in a liquid, ready-to-drink state. Consequently, the container takes on the full weight and volume of the ready-to-drink beverage whether or not the consumer is ready to drink. This weight and volume may not pose a significant disadvantage if only one container is being transported but, for example, to a hiker or soldier on an extended trip with no source of flavored or fortified drinks along the way, the weight and volume of multiple containers becomes a burden. Furthermore, known disposable containers generally cannot be resealed and have no suitable access for adding liquid.

Those disposable containers which require straws do not have straw-to-container accesses which satisfactorily minimize leakage during use. Those which do not require straws have drink dispensing ports which are not satisfactory in terms of spillage of beverage during drinking or which would make satisfactory collapse of the container difficult if not impossible.

The collapsible containers for drink ingredients are generally intended for repeated use and are not intended to be disposable after a single use. While they are collapsible to some extent, they do not collapse sufficiently to make it feasible to carry many of them at the same time. Since they are reusable, they are generally made of too expensive and heavy materials and of too complex structural configuration for one-time-only use.

The straws commonly in use for extracting beverages from collapsible and disposable beverage containers are supplied external to the container and are easily lost. They are inserted into the container by puncturing a hole through the container wall at a specific location near or at the top of the container, and therefore, require a sharp point on one end, an undesirable feature especially for children. The containers are difficult to transport without leakage if the beverage in the container is only partially consumed, generally requiring that the collapsible beverage container stay in an upright position and not be compressed. This problem is all the more compelling if the container is used by a very active person such as a biker, hiker or soldier.

Known telescoping straws do not provide for sealing the bottom end of the straw to prevent the entrance of liquid when the fully- or partially-filled beverage container is transported with the straw in place. Known telescoping straws do not provide adequate seals against flow of liquid between the inner and outer tubular straw members.

Caps are not supplied with the straws commonly used with collapsible and disposable beverage containers and, when they are supplied they do not adequately seal the container for transport with the straw in place.

It is, therefore, an object of this invention to provide a disposable beverage ingredients container which collapses to a substantially flat condition. Another object of this invention is to provide a disposable beverage ingredients container which stores beverage ingredients in a solid or condensed liquid state. Still another object of this invention is to provide a disposable beverage ingredients container into which the consumer can add water or other liquids at the time of consumption. It is also an object of this invention to provide a disposable beverage ingredients container in which stored ingredients can be mixed with water or other liquids at the time of consumption. A further object of this invention is to provide a disposable beverage ingredients container from which the consumer can drink directly without a straw. Yet another object of this invention is to provide a disposable beverage ingredients container which includes a straw. Another object of this invention is to provide a disposable beverage ingredients container which has a leakage resistant straw-to-container access. Still another object of this invention is to provide a disposable beverage ingredients container which has a spillage resistant filling port. It is also an object of this invention to provide a disposable beverage ingredients container which has a filling port which can be resealed. A further object of this invention is to provide a disposable beverage ingredients container with a straw that can be closed. Yet another object of this invention is to provide a disposable beverage ingredients container which is simply and inexpensively constructed. And it is an object of this invention to provide a disposable beverage ingredients container which may be resealable for future use.

Another object of this invention is to provide a straw which can be incorporated as an integral part of a collapsible or disposable beverage container. Still another object of this invention is to provide a straw which does not require a sharp point on one end. It is also an object of this invention to provide a straw that establishes a seal between the straw and the beverage container wall. A further object of this invention is to provide a telescoping straw which seals against liquid entrance or exit on both ends of the straw when it is in a collapsed condition. Yet another object of this invention is to provide a telescoping straw which effectively seals against flow of liquid between the inner and outer tubular straw members. Another object of this invention is to provide a telescoping straw which cannot be extended beyond a predetermined limit. Still another object of this invention is to provide a telescoping straw equipped with a cap which fully encloses the top of the straw. And it is an object of this invention to provide a telescoping straw equipped with a cap provides multiple seals to prevent the escape of liquid.

SUMMARY OF THE INVENTION

In accordance with the invention, a drink has a liquid-tight film pouch which is collapsible into a substantially flat condition. Drink ingredients in a solid or condensed liquid state can be stored in or added to the pouch through an opening in an upper portion of the pouch. A cover with a liquid tight seal closes the opening. The opening is located and the cover contoured to conform with the desired substantially flat storage condition.

Preferably, the pouch has opposed front and rear panels sealed together along their side edges and top and bottom panels with their perimeters sealed to the top and bottom perimeters of the front and rear panels. The top and bottom panels are foldable across their widths into the substantially flat condition and are preferably elliptical so the pouch assumes a substantially ovate horizontal cross-section condition as it is filled with liquid. In preferred embodiments, the fill opening may be approximately centered on and have a perimeter on one side of the major axis of the elliptical top panel or may be spaced away from the minor axis with its perimeter on one side of the major axis of the elliptical top panel.

The fill opening has a resealable cover which may be a plug insertable into the opening. In one embodiment, the plug and the opening have co-operable means on peripheral edges thereof for resisting inadvertent removal of the plug from the opening. For example, the cover may have a flat, thin, substantially rigid collar fixed around a perimeter of the opening and be hinged to a flat, thin, substantially rigid plug insertable into the collar. Alternatively, the fill opening can be covered with an adhesive strip. The pouch may also have a dispense opening in its top panel, preferably with its perimeter on one side of the major axis of the top panel. The dispense opening may have a straw extending through it. Preferably, the straw has a first tubular member with a closed bottom end and at least one aperture through a lower portion of its side wall and a second tubular member longer than and in reciprocally slidable abutment within the first tubular member. The second tubular member slides between a closed condition with an open bottom end of the second tubular member seated on the closed bottom end of the first tubular member and an open condition with the open bottom end of the second tubular member above an uppermost of the second tubular member apertures. Preferably, the tubular members have means on their abutting surfaces for sealing the annulus between them against flow of liquid into the bottom of the second tubular member when the bottom of the second tubular member is seated on the bottom of the first tubular member. The sealing means may, for example, be a mating annular ring and groove on the tubular members in the annulus below the lowermost aperture of the first tubular member or a conical protrusion in the bottom of the first tubular member for seating the open bottom of the second tubular in the closed condition. The straw may also include means on abutting surfaces of the tubular members for sealing the annulus against upward flow of liquid to a top of the first tubular member. This may also be accomplished by one or more sets of mating annular rings and grooves.

A cap may be used to close the open upper end of the second tubular member against upward flow of liquid. If so, it is preferred that the cap is attached to the pouch by a flexible connector so that the cap can be mounted on and removed from the upper end of the second tubular member. Means is also provided for locking the tubular members in the closed condition, such as mating male and female threads on abutting surfaces of the tubular members.

Whether the container has separate fill and dispense openings, has a common fill and dispense opening, or uses or does not use a straw, it will store the mixing ingredients in substantially flat packages which are easily stacked on each other for transport.

A preferred embodiment of the straw has an outer tubular member and an inner tubular member longer than the outer tubular member. The outer tubular member has a closed bottom end and at least two apertures through the lower portion of its side wall. The inner tubular member has an upper portion of outer diameter which is reciprocally slidable in abutment within the upper portion of the outer tubular member. The inner tubular member slides between a fully-closed condition when its open bottom end is seated on the closed bottom end of the outer tubular member and a fully-opened condition when its open bottom end is above an uppermost of the apertures in the outer tubular member. Preferably, the closed bottom end of the outer tubular member has a dome-like protrusion extending upwardly for at least partial insertion into the open bottom end of the inner tubular member so that the protrusion and the open bottom end can mate to provide a seal against flow of liquid into the open bottom end in the fully-closed condition.

It is further preferred that the annulus between the tubular members be sealed against flow of liquid when the bottom of the inner tubular member is seated on the bottom of the outer tubular member. Abutting surfaces of the tubular members are configured for this purpose by inclusion of a pair of co-operable tapered surfaces, one on the inner wall of the outer tubular member and another on the outer wall of the inner tubular member. The pair mates not lower than above the uppermost of the apertures of the outer tubular member so as to prevent flow in the annulus above the mating point. The tapers are also dimensioned to provide a concentric space in the annulus below their mating point so that liquid flows through the apertures into the inner tubular member as soon as the inner tubular member has been withdrawn from the fully closed condition. The annulus between the inner and outer walls of the tubular members may further be sealed against flow of liquid when the bottom of the inner tubular member is not fully closed. An annular bead on either the outer wall of the inner tubular member or the inner wall of the outer tubular member above the tapered surface seal will serve this purpose.

A top end seal may be formed by inclusion of another pair of tapered surfaces, one on the inner wall of the outer tubular member and another on the outer wall of the inner tubular member. This top end pair of tapered surfaces mates proximate the upper end of the outer tubular member and helps assure that liquid will not inadvertently leak from the straw outside of the container.

To prevent complete withdrawal of the inner tubular member from the outer tubular member, an annular groove in the inner wall of the outer tubular member co-operates with a ring of flexible radial tabs which extend inwardly from the circumferential wall of the annular groove and into flapping contact with the outer wall of the inner tubular member during reciprocal motion of the inner tubular member. An annular slot in the outer wall of the inner tubular member receives the tabs when the annular slot and the annular groove are aligned. The tabs have upper surfaces which, when forces on the tabs are released in the slot, abut the upper surface of the annular groove. This prohibits disengagement of the tabs from the annular slot. Thus, the elevations of the tabs and slot on their respective tubes set the predetermined limit beyond which the inner tubular member cannot be withdrawn.

The open top of the inner tubular member is preferably covered and uncovered by use of a cap. In a preferred embodiment of the cap, a plug in the top of the cap inserts into the open top end of the inner tubular member. Complementary threads on the inside of the cap sidewalls and the outside of the outer tubular member draw the cap plug and the closed bottom end of the outer tubular member toward each other cap is tightened on the threads. This simultaneously seals the open top and bottom ends of the inner tubular member in the fully-closed condition. An annular flange may be provided around the outer tubular member and positioned to lie below the cap in the fully-closed condition. A tether connects the cap to the annular flange.

In conjunction with the cap, the straw may also have another pair of top end tapered surfaces co-operable with the first top end tapered surfaces. The added pair has one tapered surface on the outer wall of the outer tubular member and the other tapered surface on the inner wall of the cap. This pair of tapered surfaces also mates at the upper end of the outer tubular member so that the upper end of the outer tubular member is squeezed between these pairs of tapers in the fully-closed condition to tightly seal the straw assembly.

BRIEF DESCRIPTION OF THE DRAWINGS

Other objects and advantages of the invention will become apparent upon reading the following detailed description and upon reference to the drawings in which.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Figure 1:
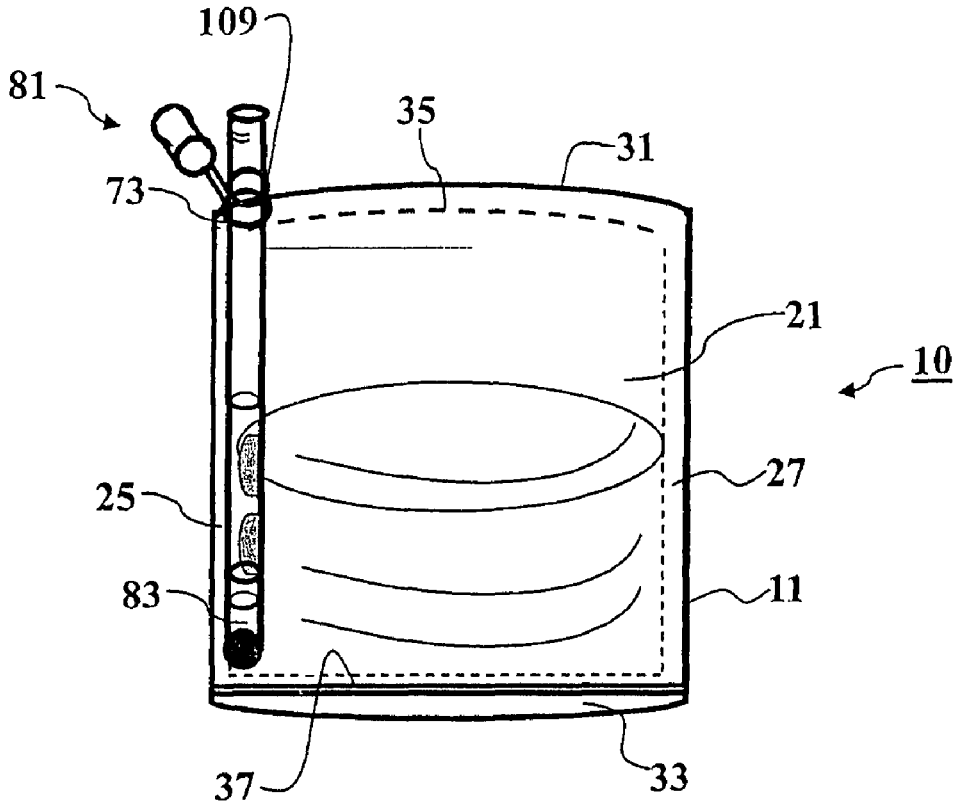
FIG. 1 is a front elevation view of an embodiment of the container with a straw.
Figure 2:
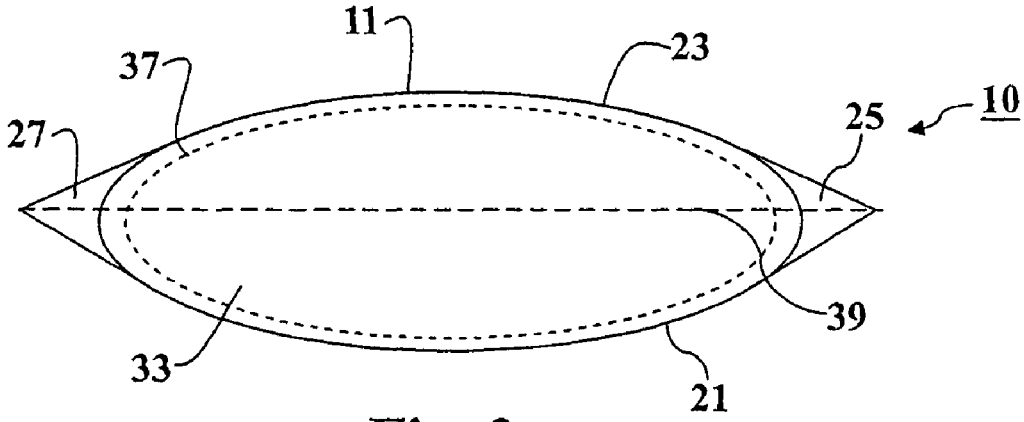
FIG. 2 is a bottom plan view of the container of FIG. 1.
Figure 3:
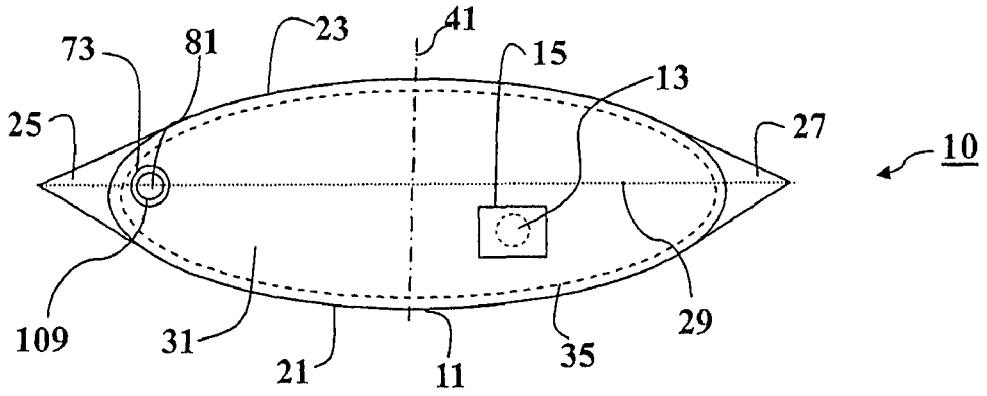
FIG. 3 is a top plan view of the container of FIG. 1.

Turning to FIGS. 1-3, a disposable container 10 for mixing and drinking liquids made by dissolving powdered ingredients or drink mixing ingredients in other than powdered form in water or other liquid is formed from a liquid-tight film pouch 11 which is collapsible into a substantially flat condition. The powdered drink ingredients, or drink mixing ingredients in other than powdered form, may be packaged in the pouch 11 or added to the pouch at the time of mixing. As seen in FIG. 3, the pouch 11 has a fill opening 13 in its upper portion and a means for closing 15 the fill opening with a liquid tight seal. The fill opening 13 provides access to the pouch 11 for introduction of the ingredients and liquid into the pouch 11 for mixing and may also be used for dispensing the mixed drink from the pouch 11. The location of the fill opening 13 and the contour of the closing means 15 are coordinated for conformance of the closing means 15 with the desired substantially flat condition of the pouch 11 in its storage condition.

Continuing to look at FIGS. 1-3, the pouch 11 has opposed front and rear panels 21 and 23 which are sealed together along their side edges 25 and 27 and top and bottom panels 31 and 33 which are sealed along their perimeters to the top and bottom perimeters 35 and 37 of the front and rear panels 21 and 23. As best seen in FIGS. 2 and 3, the top and bottom panels 31 and 33 fold across their widths into the substantially flat condition. As seen in FIG. 3, the fill opening 13 is in the top panel 31. The sealed top and bottom perimeters 35 and 37 of the pouch 11 are, as shown, preferably elliptical and fold along their major axes 29 and 39 so that the flat pouch 11 assumes a substantially ovate horizontal cross-section condition as it is being filled with liquid. As shown, the perimeter of the fill opening 13 is entirely on one side of the major axis 29 of the ovate cross-section. The fill opening 13 may, as seen in FIG. 3, be spaced from or, as seen in FIG. 5, be centered on, the minor axis 41 of the top panel 31.

Figure 4:
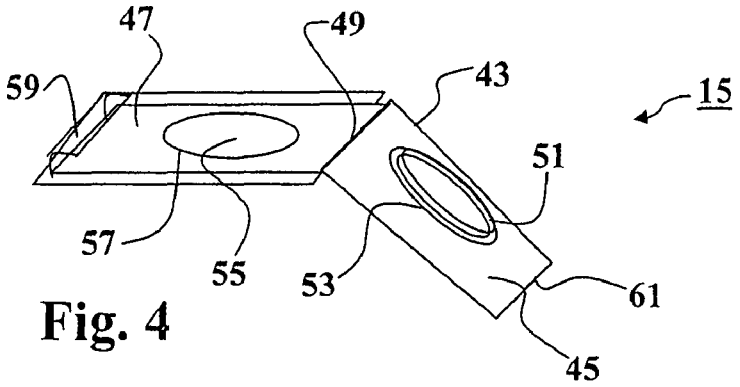
FIG. 4 is a perspective view of a flip-cap fill opening cover of the container of FIG. 1.

As seen in FIGS. 3 and 4, a flip-cap closing means 43 for the fill opening 13 has a pair of flat, thin rigid panels 45 and 47 connected by a hinge 49. One of the panels 45 has a plug 51 with a peripheral groove 53 and the other panel 47 has an opening 55 defining a collar 57 for co-operable engagement in the groove 53 of the plug 51 to resist inadvertent removal of the plug 51 from the fill opening 13. The collar 57 is dimensioned to concur with the fill opening 13 and the collar panel 47 is fixed to the pouch top panel 31 with the fill opening 13 and collar 57 aligned. The collar panel 47 also has a latch 59 which engages the unhinged end 61 of the plug panel 45 when the collar 57 and the perimeter of the fill opening 13 are engaged in the plug groove 53. The rigidity of the panels 45 and 47 facilitates manipulation of the flip-cap closure 43 and firm engagement of the plug 51 and latch 59. The location and substantially flat contour of the plug 51 permit conformance of the plug 51 to the substantially flat storage condition of the pouch 11 in both the plug-inserted condition and the plug-removed condition.

Figure 5:
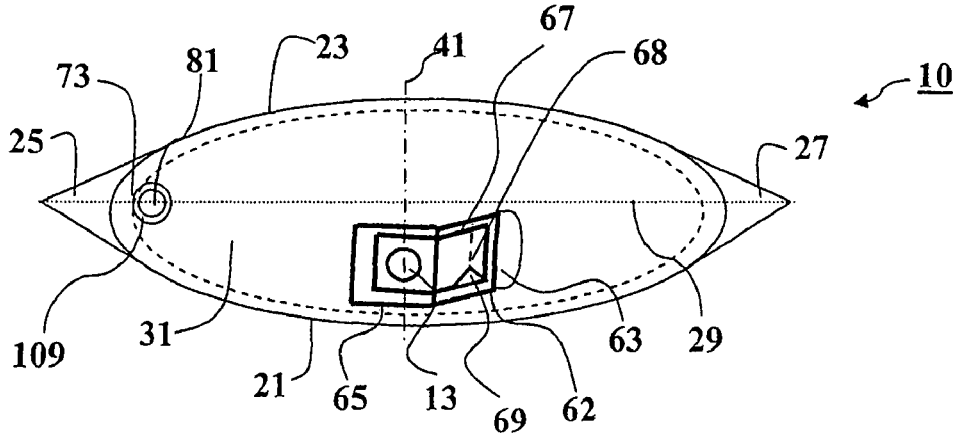
FIG. 5 is a top plan view of another embodiment of the container with an adhesive strip fill opening cover.

Looking at FIG. 5, the fill opening 13 may alternatively be covered by a flap 62 with a pull tab 63 having a base 65 permanently fixed to the container top panel 31. The base 65 has an opening aligned with the fill hole 13. The flap 62 initially closes the fill hole 13 by use of an outer adhesive seal 67. Once opened, a peel-off flap 68 can be removed to expose an inner adhesive seal 69 under the flap 68 used to close the opened fill hole 13. As shown, the fill opening 13 is disposed with its perimeter on one side of the major axis 29 of the pouch top panel 31 and centered on the minor axis 41 of the top panel 31.

Figure 7:
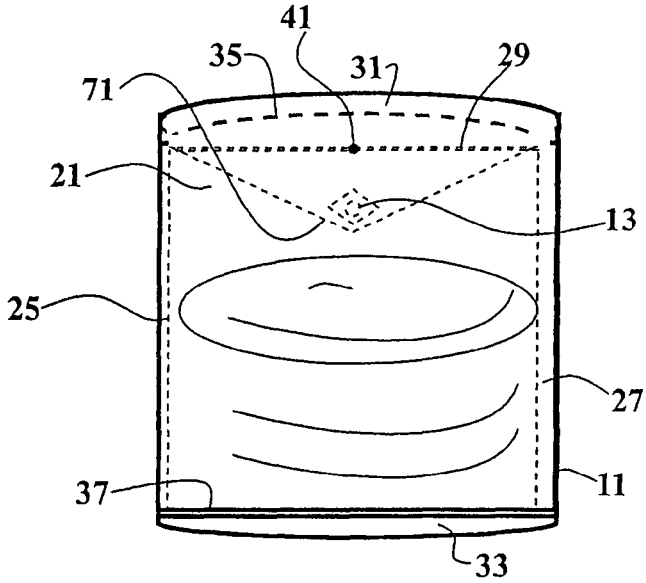
FIG. 7 is a front elevation view of another embodiment of the container without a straw.

As seen in FIGS. 3, 5 and 7, the same opening 13 can be used without a straw for both filling and dispensing and, for drinking without a straw, the top panel 31 may preferably be configured to provide a taper 71 to an opening below the minor axis 41 of the top panel 31. This facilitates manipulation of the pouch 11 during drinking and filling to an efficient flow configuration.

Figure 8:
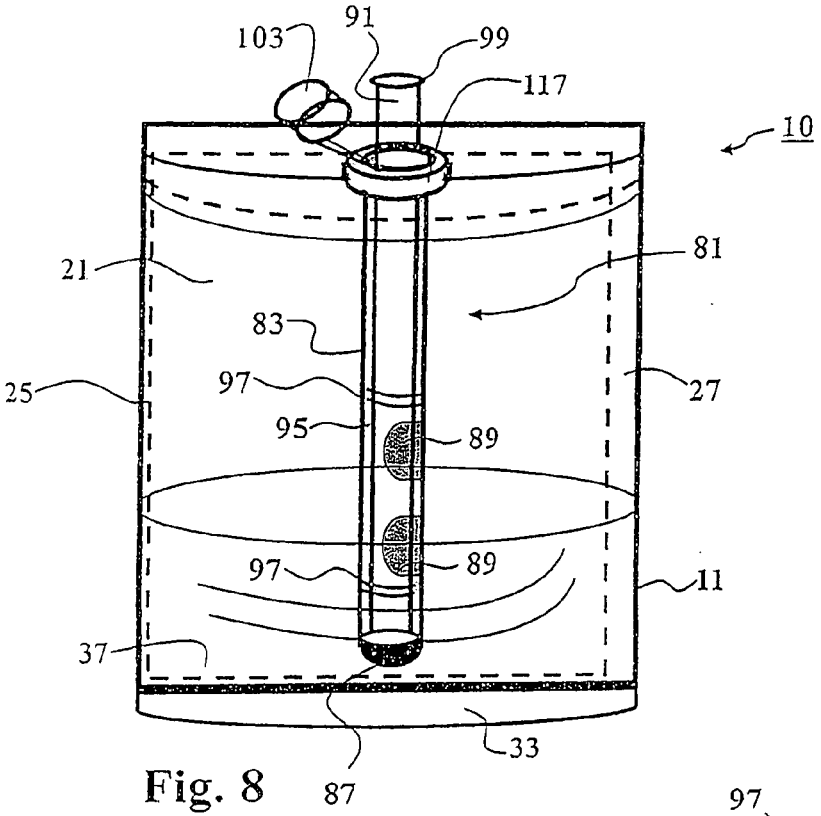
FIG. 8 is a front elevation view of another embodiment of the container with a straw.
Figure 9:
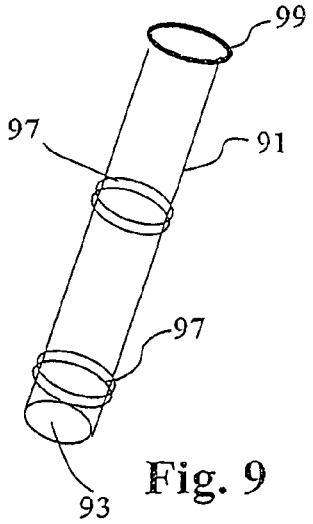
FIG. 9 is a perspective view of the inner tubular member of the straw of FIG. 8.
Figure 10:
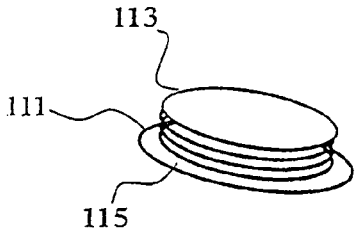
FIG. 10 is a perspective view of the fill hole insert of the container of FIG. 8.
Figure 11:
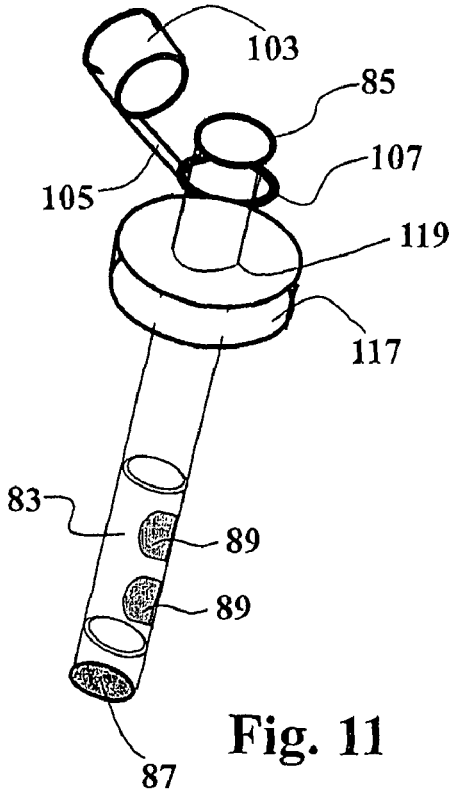
FIG. 11 is a perspective view of the outer tubular member and screw cap of the container of FIG. 8.
Figure 12:
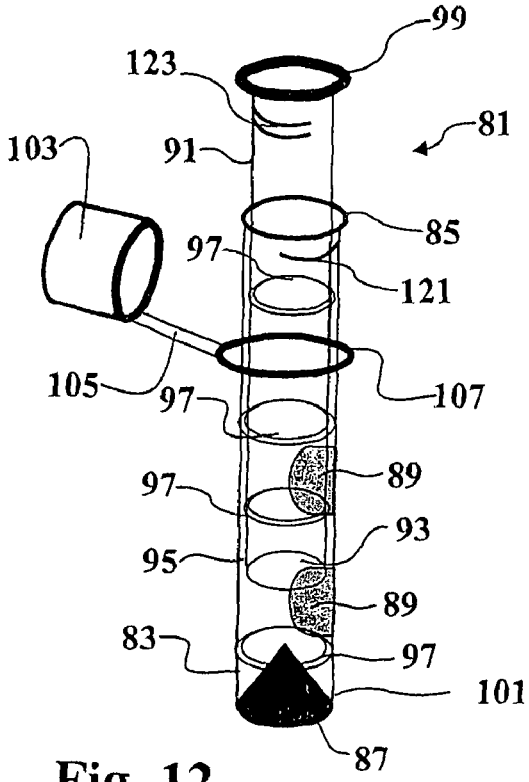
FIG. 12 is a perspective view of a conical seal embodiment of the straw.

Returning to FIG. 3, another opening 73 may be provided in the pouch 11, as shown proximate one end of the top panel 31 with its perimeter on the major axis 29 of the panel 31, for dispensing the mixed drink from the pouch 11. Looking at FIG. 1, a straw 81 extends through the dispense opening 73 to proximate the bottom panel 33 of the pouch 11. The straw 81, best seen in FIGS. 6 and 8-11, has an outer tubular member 83 with an open upper end 85 and a closed bottom end 87. At least one aperture 89 through the lower portion of the side wall of the outer tubular member 83 admits liquid from the pouch 11 into the outer tubular member 83. The straw 81 also has an inner tubular member 91 longer than the outer tubular member 83. The inner member 91 slides reciprocally in abutment within the outer tubular member 83 between a closed condition in which the open bottom 93 of the inner tubular member 91 is seated on the closed bottom 87 of the first tubular member 83 and an open condition in which the open bottom 93 of the inner tubular member 91 is positioned above the uppermost aperture 89 in the outer tubular member 83. In the closed condition, liquid cannot freely pass through the apertures 89 in the outer tubular member 83 into the annulus 95 between the tubular members 83 and 91 or into the bottom 93 of the inner tubular member 91 from the annulus 95. The resulting labyrinth effectively blocks flow of liquid into the inner tubular member 91. In the open condition, liquid passes freely through every aperture 89 in the outer tubular member 83 and into the bottom 93 of the inner tubular member 91. Between the open and closed conditions, liquid flows through exposed portions of the apertures 89 in the outer tubular member 83 into the bottom 93 of the inner tubular member 91. To further assure a seal of the annulus 95, means such as sets of mating annular rings and grooves 97 can be positioned on the abutting surfaces of the tubular members 83 and 91. In the closed condition, at least one annular ring and groove set 97, located below the lowermost aperture 89 in the outer tubular member 83, mate at the same time that the bottom 93 of the inner tubular member 91 seats on the bottom 87 of the outer tubular member 83. In the open condition, at least one mating annular ring and groove set 97 is located above the uppermost aperture 89 in the outer tubular member 83. Seal of the annulus 95 may be accomplished in other ways such as, for example as seen in FIG. 12, a conical protrusion 101 in the bottom 87 of the outer tubular member 83 can seat the open bottom 93 of the inner tubular member 91 in the closed condition. The open upper end 99 of the inner tubular member 91 can also be provided with a cap 103 to block upward flow of liquid through the inner tubular member 91. The cap 103 can be attached by a flexible connector 105 to a mounting ring 107 on the straw 81, as seen in FIGS. 6 and 8, or to the pouch 11, so that the upper end 99 of the inner tubular member 91 can be opened and closed as needed.

Going back to FIGS. 1 and 3, the junction of the perimeter of the dispense opening 73 with the perimeter of the outer tubular member 83 of the straw 81 preferably has a liquid flow preventing seal 109, perhaps accomplished by heat welding. Alternatively, as seen in FIGS. 8-11, an insert 111 with a threaded neck 113 aligned with the fill opening 13 of any embodiment and a base 115 fixed to the pouch 11 can be covered with a screw cap 117. Such a closure can be used to cover either the fill or dispense openings 13 or 73. In a straw type embodiment of the container 10, either the screw cap 117 is provided with an opening 119 which snugly girts the outer tubular member 83 of the straw 81 or the screw cap 117 is integrally molded with the outer tubular member 83 of the straw 81. The structure and operation of the tubular members 83 and 91 is otherwise substantially as hereinbefore described. The open upper end 99 of the inner tubular member 91 can also be covered with its own cap 103, also as hereinbefore described.

Figure 6:
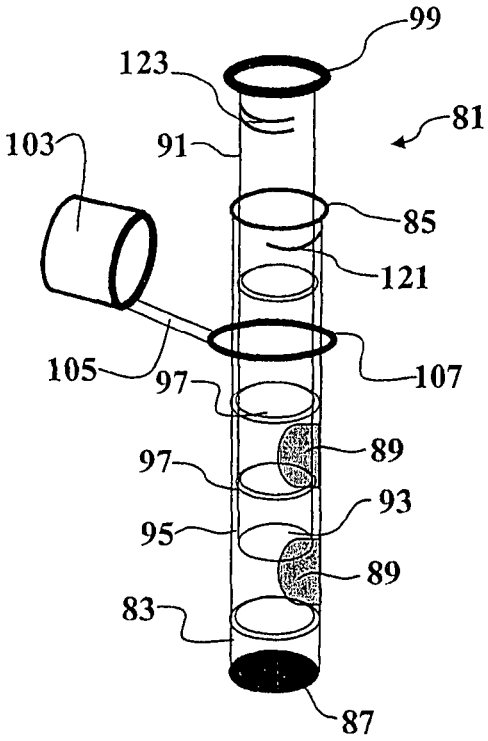
FIG. 6 is a perspective view of a typical straw for use with various embodiments of the container.

The tubular members 83 and 91 may also be locked in the closed condition, for example and as shown in FIG. 6, by use of mating male and female threads 121 and 123 on abutting surfaces of the tubular members 83 and 91 so that, in the closed condition, the inner tubular member 91 can be rotated into a sealed threaded engagement with the outer tubular member 83.

The locations of openings 13 and 73, the use of a straw 81 and the types of opening covers 43 and 63 illustrated herein are interchangeable to achieve a variety of containers in keeping with the invention. The thickness, location and orientation of the straw 81 and the various covers 43 and 63 and caps 103 and 117 described above allow the container to maintain its desired substantially flat storage condition. In the screw cap straw embodiment of FIG. 8, it may be desirable to remove the tubular members 83 and 91 from the cap 117 for storage so that the base 115 of the insert 111 will follow the fold 29 of the top panel 31 of the pouch 11 into the storage condition.

Turning to FIGS. 13-17, a preferred embodiment of the straw is illustrated. The straw 200 has an outer tubular member 210, an inner tubular member 250 and a cap 270.

The Outer Tubular Member

Figure 13:
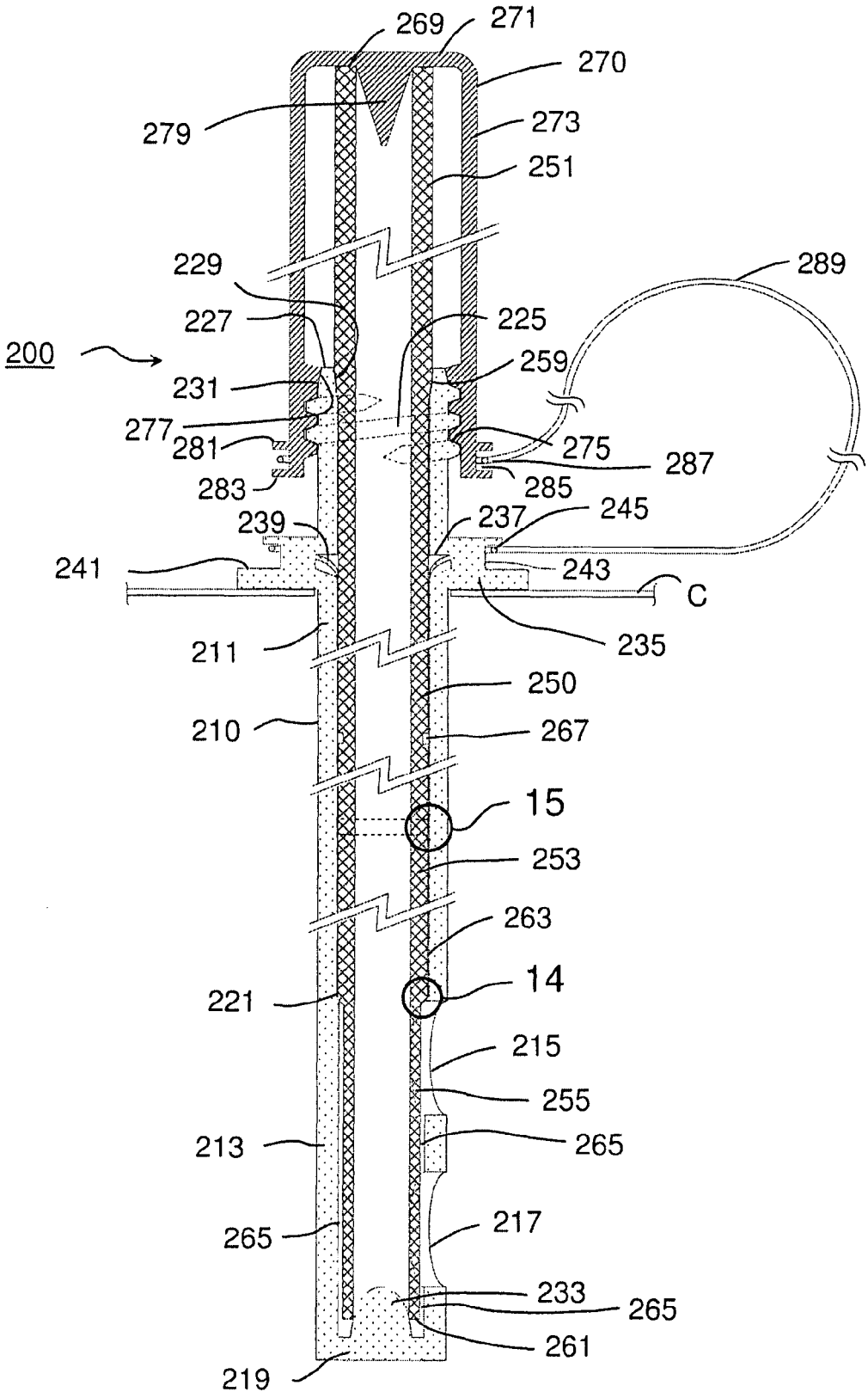
FIG. 13 is a cross-sectional view of a preferred embodiment of the straw in the fully closed condition taken along a diametric plane bisecting the outer tubular member apertures and extending through the cap tether with the straw.
Figure 14:
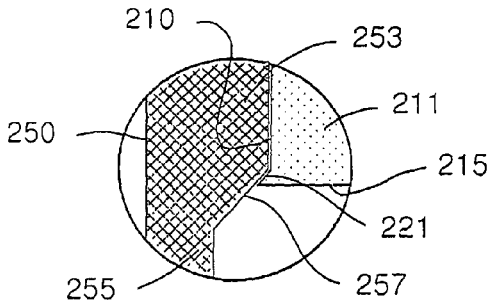
FIG. 14 is an enlarged view of the area 14 of FIG. 13.
Figure 15:
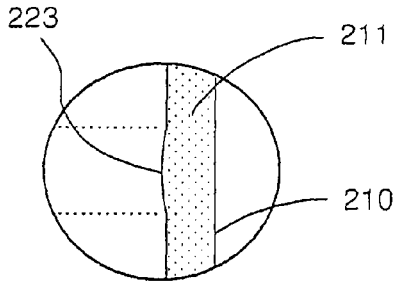
FIG. 15 is an enlarged view of the area 15 of FIG. 13.

Looking at FIG. 13, the outer tubular member 210 has a constant outer diameter, an upper portion 211 of constant inner diameter and a lower portion 213 of constant inner diameter smaller than the inner diameter of the upper portion 211. At least two apertures, as shown upper and lower large apertures 215 and 217, are vertically spaced and aligned proximate the closed bottom 219 of the outer tubular member 210 to admit liquid from the container C into the straw. The apertures 215 and 217 are ovate with their major axes aligned coaxially with the outer tubular member 210. The decrease in inner diameter is accomplished by an inside wall taper 221 at the top of the upper aperture 215, best seen in FIG. 14. As best seen in FIG. 15, the outer tubular member 210 also has an inside wall annular bubble or bead 223 spaced above the taper 221.

The outer tubular member 210 has external threads 225 at its top end 227. Inside and outside wall tapers 229 and 231 gradually narrow the thickness of the upper portion 211 of the outer tubular member 210 at its top end 227. The closed bottom end 219 of the outer tubular member 210 has a dome-like protrusion 233 which extends upwardly into the outer tubular member 210.

Figure 16:
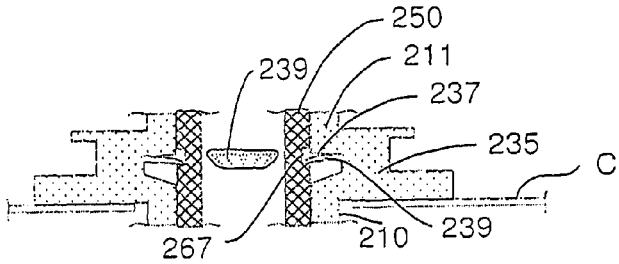
FIG. 16 is a front elevation view illustrating the withdrawal limiting mechanism at the predetermined withdrawal limit of the straw.

As best seen in FIGS. 13 and 16, the outer tubular member 210 also has an annular flange 235 proximate and below its external threads 225. The annular flange 235 is thick enough to house an annular groove 237 in the inside wall of the outer tubular member 210. A ring of resiliently flexible tabs 239 extends radially inwardly from the circumferential back wall of the annular groove 237. As is seen in FIG. 16, when no force is applied to the tabs 239, the tabs 239 extend beyond the inner diameter of the upper portion 211 of the outer tubular member 210. The upper surfaces of the tabs 239 in the no-force applied condition of FIG. 16 abut the top wall of the groove 237. The bottom wall of the groove 237 is downwardly sloped, so the tabs 239 can flex between a downwardly arced condition entirely within the groove 237, as seen in FIG. 13, and a substantially horizontal condition protruding from the groove 237, as seen in FIG. 16. The annular flange 235 shown has a wide diameter base 241 to facilitate mounting the straw on the container C and a channel 243 in its outer circumference above the base 241 for securing an O-ring-like member 245 to the outer tubular member 210.

Figure 17:
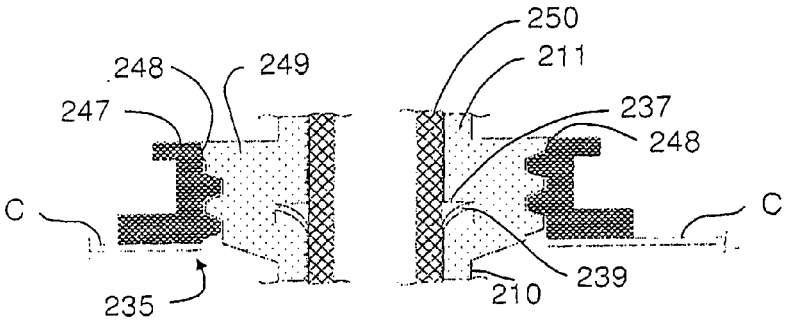
FIG. 17 is a front elevation view illustrating a modification of the flange connecting the straw of FIG. 13 to a container.

As seen in FIG. 17, illustrating a modification of the flange 235, the flange 235 may be formed in two mating segments 247 and 249. As shown, the outer and inner segments 247 and 249 are threadedly engaged. Other engagement methods, such as a tab-slot combination, could be used. Because of the mating combination, there is no need for a separate fill hole in the top panel of the container C. Filling the container C can be accomplished by unscrewing or otherwise separating the mated flange segments 247 and 249, removing the detached portion of the straw with the inner portion 249 of the flange 235 from the container C, filling the container C through the opening resulting from the removal of the inner portion 249 of the flange 235 and reinstalling the straw and inner flange 249 in the outer flange portion 247. As shown, mating tapered surfaces 248 may be provided on the top of the flange portions 247 and 249 to seal against leakage of liquid when the flange portions 247 and 249 are fully screwed together or otherwise engaged.

The Inner Tubular Member

As seen in FIG. 13, the inner tubular member 250, which is longer than the outer tubular member 210, has a constant inner diameter, an upper portion 251 of constant outer diameter, an intermediate portion 253 of constant outer diameter smaller than the outer diameter of the upper portion 251 and a lower portion 255 of constant outer diameter smaller than the outer diameter of the intermediate portion 253. The outer diameter of the intermediate portion 253 of the inner tubular member 250 is such that the intermediate portion 253 of the inner tubular member 250 is reciprocally slidable in abutment within the upper portion 211 of the outer tubular member 210. Preferably, the outer diameter of the intermediate portion 253 is so coordinated to the inner diameter of the outer tubular member 210 as to allow reciprocation of the inner tubular member 250 with minimal exertion of force while maximizing the resistance to flow of liquid between the outer tubular member 210 and the inner tubular member 250.

The decreases in outer diameter of the inner tubular member 250 are accomplished by outside wall tapers 257 and 259. Looking at FIG. 14, the lower taper 257 is positioned to mate with the taper 221 at the top of the upper aperture 215 of the outer tubular member 210 when the open bottom end 261 of the inner tubular member 250 is fully seated on the dome-like protrusion 233 on the closed bottom end 219 of the outer tubular member 210. In this, the fully closed condition, the dome-like protrusion 233 seals the otherwise open bottom end 261 of the inner tubular member 250 and the mating tapers 221 and 257 on the outer and inner tubular members 210 and 250 seals off the annulus 263 between the tubular members 210 and 250 above the mating tapers 221 and 257. The narrower diameter at the lower portion 255 of the inner tubular member 250 affords a concentric space 265 in the annulus 263 below the mating tapers 221 and 257 and across the apertures 215 and 217 in the outer tubular member 210 to prevent creation of a vacuum between the tubular members 210 and 250 as the inner tubular member 250 is withdrawn and to facilitate immediate flow of liquid through the apertures 215 and 217 into the open bottom end 261 of the inner tubular member 250 as soon as the straw is not in the fully closed condition. Looking at FIG. 13, the upper taper 259 of the inner tubular member 250 is positioned to mate with the taper 229 at the top end 227 of the outer tubular member 210 when the open bottom end 261 of the inner tubular member 250 is fully seated on the dome-like protrusion 233 on the closed bottom end 219 of the outer tubular member 210. This mating seals the annulus 263 to prevent leakage of any fluid at the top end 227 of the outer tubular member 210.

An annular slot 267 is positioned in the outside wall of the intermediate portion 253 of the inner tubular member 250. Preferably, the slot 267 is above the annular bead 223 on the inside wall of the outer tubular member 210 and below the flange 235 on the outer tubular member 210 when the straw is in the fully closed condition as seen in FIG. 13. The bead 223 seals the annulus 263 against flow of liquid when the inner tubular member 250 is withdrawn from the fully closed condition. As the inner tubular member 250 is withdrawn, the slot 267 will slide upwardly only until it comes into alignment with the ring of tabs 239 on the outer tubular member 210. At this point, as seen in FIG. 16, the tabs 239 will flap upwardly into the slot 267 until the top surfaces of the tabs 239 abut the top surface of their groove 237 in the outer tubular member 210 and the bottom surface of the slot 267 abuts the bottom surfaces of the tabs 239, preventing further withdrawal of the inner tubular member 250. Thus, the elevations of the tabs 239 and slot 267 on their respective tubular members 210 and 250 set the predetermined limit beyond which the inner tubular member 250 cannot be withdrawn. Preferably, when the inner tubular member 250 is withdrawn to the maximum limit, the open bottom end 261 of the inner tubular member 250 will still be substantially below the annular groove 237 in the outer tubular member 210. It is also preferred that, at this maximum withdrawal, the inner tubular member 250 will have been extended approximately 2" above the fully closed condition.

The inner tubular member 250 has an open top end 269 at which a consumer applies suction to draw liquid from the container C when the straw is not in the fully closed condition.

The Cap

As seen in FIG. 13, the cap 270 has a top 271 and sidewalls 273 with internal threads 275 on the open bottom of the cap 270. The internal threads 275 mate with the external threads 225 on the outer tubular member 210 to close the straw and seal against leaking to the outside of the cap 270. The cap 270 has an inside taper 277 immediately above the internal threads 275 which mates with the outside wall taper 231 at the top end 227 of the outer tubular member 210 to further assure the tight seal of the cap 270. Furthermore, if, as shown, the inner tubular member 250 has an upper portion 251 which extends into the cap 270, the top end 227 of the outer tubular member 210 will be squeezed between the pairs of taper 259 and 277 on the inner tubular member 250 and the cap 270 in the fully closed condition to enhance the seal.

The height of the cap 270 is such that top 271 of the cap 270 will close the open top end 269 of the inner tubular member 250 in the fully closed condition. A plug 279, as shown an inverted cone, extends downwardly from the top 271 of the cap 270 into the open top end 269 of the inner tubular member 250 to enhance this seal in the fully closed condition. In this configuration, tightening of the complementary threads 275 and 225 on the inside of the cap sidewalls 273 and the outside of the outer tubular member 210 draws the cap plug 279 and the closed bottom end 219 of the outer tubular member 210 toward each other. This simultaneously seals the open top and bottom ends 269 and 261 of the inner tubular member 250 in the fully-closed condition. At the same time, the co-operating tapers 221 and 257 on the outer and inner tubular members 210 and 250 and the annular bead 223 seal the annulus 263.

Annular flanges 281 and 283 on the cap 270 provide a channel 285 for securing an O-ring-like member 287 to the cap 270. A tether 289 extends between the outer tubular member O-ring-like member 245 and the cap O-ring-like member 287 so that the cap 270 will not be inadvertently lost. The tether 289 should be long and flexible enough to facilitate complete and easy application and removal of the cap 270.

The annular bead 223 could be on the outside wall of the inner tubular member 250 rather than on the inside wall of the outer tubular member 210. The various seals at the mating pairs of tapers 221 and 257, 229 and 259 and 231 and 277, at the bead 223, at the bottom end dome-like member 233, at the cap plug 279 and at the mating taper 248 of a two piece flange should be capable of preventing leakage when the liquid filled container is subjected to a minimum pressure predetermined according to intended use.

Thus, it is apparent that there has been provided, in accordance with the invention, a disposable collapsible powdered drink mixing container and telescoping straw that fully satisfy the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A straw comprising:

an outer tubular member having a closed bottom end and at least one aperture through a lower portion of a side wall thereof;

an inner tubular member longer than said outer tubular member and having a lower portion of diameter defining an annulus between said inner and outer tubular members, said inner tubular member having an upper portion of outer diameter reciprocally slidable in abutment within an upper portion of said outer tubular member between a full-closed condition with an open bottom end of said inner tubular member seated on said closed bottom end of said outer tubular member and a full-opened condition with said open bottom end of said inner tubular member above an uppermost of said at least one aperture;

a first pair of tapered surfaces, said first pair having one of said surfaces on an inner wall of said outer tubular member and another of said surfaces on an outer wall of said inner tubular member, said pair of tapered surfaces mating not lower than above an uppermost of said at least one aperture of said outer tubular member and providing a concentric space in said annulus; and a second pair of tapered surfaces, said second pair having one of said surfaces on an outer wall of said outer tubular member and another of said surfaces on an inner sidewall of a cap for covering and uncovering an open top end of said inner tubular member, said second pair of tapered surfaces mating at an upper end of said outer tubular member, whereby said upper end of said outer tubular member is squeezed by said pairs of tapers in said fully-closed condition.

2. A straw according to claim 1, said closed bottom end of said outer tubular member having a dome-like protrusion extending upwardly therefrom for at least partial insertion into said open bottom end of said inner tubular, said protrusion and said open bottom end mating to provide a seal against flow of liquid into said open bottom end in said fully-closed condition.

3. A straw according to claim 1, said sealing means further comprising another pair of tapered surfaces, said another pair having one of said surfaces on an inner wall of said outer tubular member and another of said surfaces on an outer wall of said inner tubular member, said another pair of tapered surfaces mating proximate an upper end of said outer tubular member.

4. A straw according to claim 1 further comprising means for preventing withdrawal of said inner tubular member beyond a predetermined limit.

5. A straw according to claim 4, said means for preventing withdrawal comprising:

an annular groove in an inner wall of said outer tubular member; and a ring of flexible radial tabs extending inwardly from a circumferential wall of said annular groove into flapping contact with an outer wall of said inner tubular member in response to reciprocal motion of said inner tubular member in said outer tubular member.

6. A straw according to claim 5, said means for preventing withdrawal further comprising an annular slot in an outer wall of said inner tubular member for receiving said tabs when said annular slot and said annular groove are aligned, said tabs having upper surfaces which abut an upper surface of said annular groove to prohibit disengagement of said tabs from said annular slot.

7. A straw according to claim 1 further comprising means for sealing an annulus between said inner wall of said outer tubular member and said outer wall of said inner tubular member against flow of liquid therethrough when said bottom of said inner tubular member is spaced above said bottom of said outer tubular member.

8. A straw according to claim 7, said means for sealing comprising an annular bead on at least one of an outer wall of said inner tubular member and an inner wall of said outer tubular member.

9. A straw according to claim 1 further comprising means for covering and uncovering an open top end of said inner tubular member.

10. A straw according to claim 9, said means for covering and uncovering comprising:

means for plugging said open top end of said inner tubular member; and means for engaging and disengaging said means for plugging to and from a top end of said outer tubular member.

11. A straw according to claim 10, said means for engaging and disengaging drawing said means for plugging said open top end of said inner tubular member and said closed bottom end of said outer tubular member toward each other during engagement to simultaneously seal said open top and bottom ends of said inner tubular member in said fully-closed condition.

12. A straw according to claim 9, said means for covering and uncovering comprising:

a cap having a top and sidewalls;

a plug in said top of said cap for insertion into said open top end of said inner tubular member; and complementary threads on an inside of said cap sidewalls and an outside of said outer tubular member for drawing said cap plug and said closed bottom end of said outer tubular member toward each other during tightening rotation of said threads to simultaneously seal said open top and bottom ends of said inner tubular member in said fully-closed condition.

13. A straw according to claim 12 further comprising an annular flange around said outer tubular member and below said cap in said fully-closed condition.

14. A straw according to claim 12, said straw further comprising means on abutting surfaces of said tubular members for sealing an annulus therebetween against flow of liquid therethrough when said bottom of said inner tubular member is seated on said bottom of said outer tubular member.

15. A straw according to claim 14 further comprising a tether connected between said cap and said annular flange.

16. A straw comprising:

an outer tubular member having a closed bottom end and at least one aperture through a lower portion of a side wall thereof;

an inner tubular member longer than said outer tubular member, said inner tubular member having an upper portion of outer diameter reciprocally slidable in abutment within an upper portion of said out tubular member between a fully-closed condition with an open bottom end of said inner tubular member seated on said closed bottom end of said outer tubular member and a fully-opened condition with said open bottom end of said inner tubular member above an uppermost of said at least one aperture;

a first pair of tapered surfaces, said first pair having one of said surfaces on an inner wall of said outer tubular member and another of said surfaces on an outer wall of said inner tubular member, said first pair of tapered surfaces mating at an upper end of said inner tubular member; and a second pair of tapered surfaces, said second pair having one of said surfaces on an outer wall of said outer tubular member and another of said surfaces on an inner sidewall of a cap for covering and uncovering an open top end of said inner tubular member, said second pair of tapered surfaces mating at an upper end of said outer tubular member, whereby said upper end of said outer tubular member is squeezed by said second pair of tapers in said fully-closed condition.

17. A straw comprising:

an outer tubular member;

an inner tubular member longer than said outer tubular member, said inner tubular member being reciprocally slidable in abutment within said outer tubular member;

means for sealing an annulus between an inner wall of said outer tubular member and an outer wall of said inner tubular member against flow of liquid therethrough;

an annular groove in an inner wall of said outer tubular member; and a ring of flexible radial tabs extending inwardly from a circumferential wall of said annual groove into flapping contact with an outer wall of said inner tubular member in response to reciprocal motion of said inner tubular member in said outer tubular member, said ring of tabs and said annular groove being cooperable to prevent withdrawal of said inner tubular member beyond a predetermined limit.

18. A straw according to claim 17, said means for sealing comprising an annular protrusion on at least one of said inner wall of said outer tubular member and said outer wall of said inner tubular member.

19. A straw according to claim 18, said sealing means further comprising a pair of tapered surfaces, said pair having one of said surfaces on an inner wall of said outer tubular member and another of said surfaces on an outer wall of said inner tubular member, said pair of tapered surfaces mating proximate an upper end of said outer tubular member.

20. A straw according to claim 17, said means for preventing withdrawal further comprising an annular slot in an outer wall of said inner tubular member for receiving said tabs when said annular slot and said annular groove are aligned, said tabs having upper surfaces which abut an upper surface of said annular groove to prohibit disengagement of said tabs from said annular slot.

21. A straw according to claim 18 further comprising means for covering and uncovering an open top end of said inner tubular member.

22. A straw comprising:

an outer tubular member having a closed bottom end and at least one aperture through a lower portion of a side wall thereof;

an inner tubular member longer than said outer tubular member and having a liquid inlet end and a liquid outlet end, said inner tubular member having an upper portion of outer diameter reciprocally slidable in abutment within an upper portion of said outer tubular member, said inner tubular member being reciprocally slidable between a fully-closed condition with an open liquid inlet end of said inner tubular member seated on said closed bottom end of said outer tubular member and a fully-opened condition with said open liquid inlet end of said inner tubular member raised above said closed bottom end of said outer tubular member and in liquid communication with said at least one aperture; and a pair of tapered surfaces, said pair having one of said surfaces on an outer wall of said outer tubular member and another of said surfaces on an inner sidewall of a cap for covering and uncovering an open top end of said inner tubular member, said pair of tapered surfaces mating at an upper end of said outer tubular member, whereby said upper end of said outer tubular member is squeezed by said pair of tapers in said fully-closed condition.

23. A straw comprising:

an outer tubular member having a closed bottom end and at least one aperture through a lower portion of a side wall thereof;

an inner tubular member longer than said outer tubular member, said inner tubular member having an upper portion of outer diameter reciprocally slidable in abutment within an upper portion of said outer tubular member between a fully-closed condition with an open bottom end of said inner tubular member seated on said closed bottom end of said outer tubular member and a fully-opened condition with said open bottom end of said inner tubular member above an uppermost of said at least one aperture; and a pair of tapered surfaces having one of said surfaces on an outer wall of said outer tubular member and another of said surfaces on an inner sidewall of a cap for covering and uncovering an open top end of said inner tubular member, said second pair of tapered surfaces mating at an upper end of said outer tubular member, whereby said upper end of said outer tubular member is squeezed by said pair of tapers in said fully-closed condition.

* * * * *